US005873781A

United States Patent [19]

Keane

[11] Patent Number: 5,873,781

[45] Date of Patent: Feb. 23, 1999

[54] GAMING MACHINE HAVING TRULY RANDOM RESULTS

[75] Inventor: Martin A. Keane, Chicago, Ill.

[73] Assignee: Bally Gaming International, Inc., Las Vegas, Nev.

[21] Appl. No.: 749,292

[22] Filed: Nov. 14, 1996

[51] Int. Cl.[6] ..... A63F 9/00

[52] U.S. Cl. ..... 463/22

[58] Field of Search ..... 463/20, 21, 22; 273/274; 364/717.01, 717.02, 717.06

[56] References Cited

U.S. PATENT DOCUMENTS 3,580,581 5/1971 Raven .
4,448,419 5/1984 Telnaes .
4,858,932 8/1989 Keane .
5,490,670 2/1996 Hobert ..... 463/22

OTHER PUBLICATIONS

Alastair J. Walker, "An Efficient Method For Generating Discrete Random Variables With General Distributions," *ACM Transactions on Mathematical Software*; vol. 3, No. 3, Sep. 1977, pp. 253–256.

G. Marsaglia, "Generating Discrete Random Variables in a Computer," *Communications of the ACM 6, 1* (1963), pp. 37–38.

*Primary Examiner*—George Manuel
*Attorney, Agent, or Firm*—Jenner & Block

[57] ABSTRACT

A gaming machine produces truly random results using a noisy oscillator to randomly vary the frequency of a clock signal used to cycle a counter through its states. Multiple random numbers can be generated during the same game using the same circuitry, yet still achieve truly random results.

25 Claims, 6 Drawing Sheets

| FIG. 2A |
|---|
| FIG. 2B |

FIG. 3

| REEL STOP POSITION | PROBABILITY, % | MAIN ARRAY | ALIAS ARRAY |
|---|---|---|---|
| 0 | 1.5625 | 127 | 5 |
| 1 | 3.1250 | 255 | 0 |
| 2 | 1.5625 | 127 | 17 |
| 3 | 3.1250 | 255 | 0 |
| 4 | 1.5625 | 127 | 21 |
| 5 | 6.2500 | 255 | 0 |
| 6 | 1.5625 | 127 | 5 |
| 7 | 4.6875 | 255 | 0 |
| 8 | 4.6875 | 255 | 0 |
| 9 | 4.6875 | 255 | 0 |
| 10 | 1.5625 | 127 | 7 |
| 11 | 3.1250 | 255 | 0 |
| 12 | 4.6875 | 255 | 0 |
| 13 | 4.6875 | 255 | 0 |
| 14 | 4.6875 | 255 | 0 |
| 15 | 4.6875 | 255 | 0 |
| 16 | 1.5625 | 127 | 8 |
| 17 | 6.2500 | 255 | 0 |
| 18 | 1.5625 | 127 | 9 |
| 19 | 4.6875 | 255 | 0 |
| 20 | 1.5625 | 127 | 12 |
| 21 | 6.2500 | 255 | 0 |
| 22 | 1.5625 | 127 | 13 |
| 23 | 3.1250 | 255 | 0 |
| 24 | 1.5625 | 127 | 14 |
| 25 | 3.1250 | 255 | 0 |
| 26 | 3.1250 | 255 | 0 |
| 27 | 1.5625 | 127 | 15 |
| 28 | 3.1250 | 255 | 0 |
| 29 | 1.5625 | 127 | 17 |
| 30 | 1.5625 | 127 | 19 |
| 31 | 1.5625 | 127 | 21 |

GAMING MACHINE HAVING TRULY RANDOM RESULTS

BACKGROUND OF THE INVENTION

1. Field of the Invention

The invention relates to gaming machines generally, and more particularly to gaming machines requiring generation of random numbers.

2. Description of the Related Art

Gaming machines include games of chance such as slot machines. The traditional mechanical slot machine includes three or four symbol-bearing reels, which are rotatably mounted on a common axis. The symbols are located on the peripheries of the reels, and are typically pictures of bells, bars and fruit. There are also "blank" symbols, which are the portions of the reels' peripheries in between the picture symbols. A line (the "win line") is placed adjacent to the reels, so that when the reels are at rest, at least one symbol from each reel is visually associated with the win line.

To play the slot machine, the player spins the reels by pulling a lever which is mechanically linked to the reels. After a brief period of spinning, the reels come to rest, each reel displaying a symbol or blank space along the win line. The displayed combination of symbols is a random game outcome, and corresponds to a predetermined payout, which may be zero. The payout for a particular game outcome usually depends on the probability of that game outcome occurring.

Each reel's final resting position will be one of a plurality of possible predetermined and discrete "reel stop positions." At each reel stop position, a particular part of the reel's periphery (either a symbol or a blank space) is displayed at the win line. Thus, each reel stop position is associated with a particular symbol or blank. In a mechanical slot machine, the probability of a particular symbol being displayed at the win line is $N_S$ divided by $N_R$, where $N_R$ is the total number of reel stop positions, and $N_S$ is the number of reel stop positions associated with the particular symbol. Where a symbol is associated with only a single reel stop position, its probability of being displayed is one in $N_R$. Thus, the range or "spectrum" of probabilities that can be developed in each reel of a mechanical slot machine is 1:1 through $1:N_R$.

In the 1970's, manufacturers developed electronic versions of the traditional mechanical slot machine. In these electronic machines, the reels are computer controlled, and there is no mechanical linkage between the lever and the reels. Instead, when the user pulls the lever, the computer randomly selects reel stop positions for each of the reels, and then sets the reels into motion with a motor. The reels are allowed to spin for a short time, and then are stopped at the selected reel stop positions.

In effect, the game result for each reel is determined by the computer, with the spinning reels used only to display that result. Thus, in some machines, the reels are eliminated altogether, and the game outcome displayed on a video screen. The video display is often a representation of spinning reels, to preserve the charm and excitement of the traditional slot machine.

In determining a game outcome, the computer simulates the mechanical slot machines by randomly picking reel stop positions for each reel. A table in the computer's memory indicates which symbol (or blank space) is associated with each reel stop position, so the computer can determine the game outcome (that is, the ultimate combination of selected symbols).

In a mechanical reel slot machine, the spinning reel is equally likely to come to rest at one reel stop position as another. Thus, each reel stop position has an equal chance of being "selected." This is referred to as a "uniform probability distribution." For example, in a three-reel uniform probability machine with thirty-two reel stop positions on each reel, the lowest possible probability for a particular game outcome is one chance in $32^3$ (or 1:32,768). Assuming each play costs one dollar, the payout for this particular game outcome cannot exceed $32,768, without the game losing money over time to the players.

In an electronic slot machine, the computer also can pick reel stop positions in accordance with a uniform probability distribution. Alternatively, the computer can assign different probabilities to different reel stop positions. This is referred to as "nonuniform probability distribution." The advantage of nonuniform distributions is that they allow the spectrum of game result probabilities to be greatly expanded. Thus, in a nonuniform probability system, certain game outcomes can be assigned low probabilities, such as, for example, one in one million. The corresponding payout can be increased without making the machine unprofitable; in this example, the payout could be one million dollars (assuming a one dollar bet). These high payouts, although extremely rare, are attractive to many players, and therefore are a desirable feature to have on a gaming machine.

One way in which expanded probability spectrums have been implemented in slot machines is by using a "virtual" reel. A virtual reel is a model of a physical reel that exists only in the computer's memory. The virtual reel can have a large number of reel stop positions—far more than a physical reel. Each reel stop position in the virtual reel is associated with a particular symbol. Symbols corresponding to higher payouts are associated with only a few (or even one) virtual reel stop positions. Thus, the probability of a game outcome including such symbols is greatly reduced. Because the virtual reel has more reel stop positions than a physical reel, its probability spectrum is increased.

Another technique for generating random results, both uniform and nonuniform, in gaming machines is the "time-based" method. In the time-based method, game outcomes are represented by the contents of a digital counter or other suitable finite state machine. The counter has a range of zero to thirty-one, for example, and each of its thirty-two possible values corresponds to a game result. The counter rapidly and repetitively cycles through its range. At an arbitrary point in time, a player presses a button and interrupts the counter, leaving it suspended on a particular number. This number is random in the sense that it can not be predicted by the player, and the event corresponding to this number is selected as the game outcome.

It has been recognized that the odds of selecting a particular number (that is, game result) can be varied by adjusting the relative amount of time that the counter holds each number. Thus, if the counter holds one number longer than the others, it is more likely to be holding that number than the others when it is interrupted by the player. Likewise, if the counter spends less time holding a particular number, then it is less likely that the counter will be holding that number when it is interrupted by the player. To vary the time which the counter spends at each number, the counter can be driven by a variable frequency astable multivibrator. Each cycle of the multivibrator generates a pulse, which increments the counter. The duration of the period between pulses is controlled by a series of RC networks, each having a different resistance value. The networks are successively electronically coupled to the multivibrator each time the counter is incremented. Thus, the intervals between pulses (and, consequently, the amount of time the counter spends at each number) vary in accordance with the value of the resistor in the particular RC network which is coupled to the multivibrator.

Where a gaming machine requires more than one random number to be chosen, e.g., a slot machine having more than one reel, achieving truly random results is more difficult. One way to select a random reel stop position for each reel is to use a separate counter and related circuitry for each reel. Although such a system might yield truly random results for each of the reels, additional costs are introduced into the gaming machine due to the additional components. However, in conventional gaming machines, querying the same circuit once for each reel in a multireel machine in order to select a random reel stop position for each reel does not result in truly random results for any reel beyond the first.

For example, in the gaming machine described above, when a player initiates game play, the microprocessor interrupts the counter or other state machine in order to determine a first random number to be translated and displayed as a symbol on the first reel of the slot machine. Because the player's initiation of the game can occur at any point in time and with the counter in any one of its possible states, this first random number is truly random. However, the second and any subsequent "random" numbers generated during the same game by the same circuitry are not truly random. These subsequent "random" numbers are chosen at a predetermined, fixed amount of time after the first random number is chosen and each complete cycle of the counter through all of its states takes the same amount of time. Thus, given the first random number, the second random number is a foregone conclusion—i.e., it will be the value stored in the counter at the fixed amount of time after the first random number is chosen. Therefore, the second random number is not truly random because not all of the potential numbers can be selected as the second random number given the first random number. The same problem occurs for a third reel and any subsequent reels.

This problem is illustrated schematically in FIG. 1. In FIG. 1, an arrow rotates with a constant angular velocity. The circle depicted in FIG. 1 includes 32 sectors of varying size. Each sector represents one number in the range of [0 . . . 31]. These numbers depict schematically the value held by a counter in a nonuniform probability distribution using a time-based method. Thus, the counter holds the different values for different lengths of time because the arrow rotates at a constant speed and the sectors are of different sizes. Thus, in FIG. 1, it can be seen that the counter holds the value "5" for a relatively short period of time and the value "8" for a relatively long period of time. The first random number chosen by the gaming machine is the value at which the arrow points at the randomly chosen starting point of the game—e.g., when the player initiates game play by pushing a button. Once this first random number is selected, the position of the arrow at a fixed amount of time later is predetermined because the arrow rotates at a constant angular velocity. This problem holds true for the second and any subsequently chosen random numbers in a game. Thus, the second and any subsequent random numbers are not truly random.

One way to obtain truly random numbers for the second and subsequent numbers is to incorporate an additional circuit for each subsequent reel for which a random number is chosen. However, this would increase the cost of the slot machine and multiply any maintenance difficulties.

Thus, there is a need for a gaming machine having the ability to produce truly random results on each reel when choosing more than one random number during a game without having the added expense of a dedicated circuit for each random number to be chosen.

Another problem arises due to the fact that current gaming machines do not provide truly random numbers but algorithmically derived pseudo-random numbers generated by a pseudo-random number generator (a "PRNG"). These pseudo-random numbers are often the apparently random and independent output of a finite state machine whose next state is a function only of its current state. By definition, such a machine only has a finite number of states ("Nstates"). Therefore, its output must eventually repeat.

For example, maximal length finite state machine PRNGs having state variables of 16, 32 and 64 bits have Nstates of 65,536; $4.2949\times10^{9}$; and $1.844\times10^{19}$, respectively. The number of distinct output sequences is at most equal to the PRNG's Nstates because the sequence of outputs from the PRNG is determined by its state prior to the first call to it. Traditionally, gaming machines have had outcomes the most rare of which has a probability of occurring that is much greater than 1/Nstates so that the conformity of the game performance can be ascertained by actually calling the PRNG enough times to verify the performance. However, new games are being proposed for which this is no longer true.

For example, it has been proposed to have a video poker gaming machine with a top prize being awarded for an in-line royal flush (i.e., Ace-King-Queen-Jack-Ten from left to right on the screen). One way to obtain poker hands on a gaming machine is to make ten calls to the random number generator and use the results to obtain the top ten cards of a shuffled deck. The number of cases that must be distinguished is about $5.74\times10^{16}$ because the order in which the cards appear is important.

As a second example, a keno gaming machine can have an outcome that requires 20 calls to the random number generator to obtain the top 20 balls of a shuffled 80-ball "deck." The order of the draw plays no role so the number of distinguishable cases is about $3.5\times10^{18}$.

As a third example, a 9-reel slot machine with 100 stops per reel has been proposed. Such a gaming machine would require calling the random number generator 9 times. The number of distinguishable outcomes is $100^{9}$ (or $10^{18}$).

In each of these three examples, it is clear that a 16 or 32 bit PRNG could not produce all possible outcomes. Moreover, it would be difficult to argue that a 64-bit PRNG could produce all outcomes uniformly. This leads to suspicion of any PRNG for use in a game where the number of distinguishable outcomes is such as to preclude testing of sufficient duration to verify that all outcomes occur with a desired prespecified probability. Such testing is not practical for the above-referenced examples. For example, a keno test, with a billion draws per second, would require 100 years to record the $3.5\times10^{18}$ equally likely draws.

These issues are extremely important in the gaming industry because a proprietor must demonstrate to the satisfaction of gaming regulators that a gaming machine will produce outcomes in accordance with the stated probabilities. The actual physical drawing of balls in a real live keno draw poses no problem in satisfying gaming regulators because the drawing of each ball is a truly independent physical event and, as such, the probability of each of the possible outcomes can be determined from this single physical observation and application of the laws of probability.

Thus, there is a need for a mechanism to be employed in a gaming machine that produces truly independent random results based on an independent physical process so that similar arguments can be used to demonstrate the probabilities of the rare events in games such as the newly proposed games described above.

SUMMARY OF THE INVENTION

A gaming machine in accordance with the present invention provides truly random results. The gaming machine includes a circuit for generating a random game result. The circuit includes means for generating truly random events and means for producing, in accordance with at least one prespecified probability distribution, independent game results based upon said truly random events. The generating means can include a noise diode. The gaming machine also includes means for displaying the game result.

In another embodiment, the gaming machine generally can include a circuit for generating a random value. The circuit can receive a clock input signal generated by a noisy oscillator. The clock input signal has a random frequency. The gaming machine also can include means for selecting a state of the circuit as the random value, means for translating the random value into a game result and means for displaying the game result. The noisy oscillator can include a digital noise source, which can include a shift register. Alternatively, the noisy oscillator can include means for generating noise from independent physical process. The generating means can include a noise diode and at least one op amp for amplifying the noise generated by the noise diode.

Another gaming machine in accordance with the present invention generally can include a circuit for generating a random game result. At least a portion of the circuit forms a finite state machine wherein each state corresponds to a potential game result. The circuit has a clock input. The gaming machine also includes a noisy oscillator having a noisy oscillator output. The noisy oscillator generates a clock input signal having a random frequency on the noisy oscillator output. The clock input signal is provided to the clock input and clocks the finite state machine through its states. The gaming machine also provides means for selecting a state of the finite state machine and means for translating the selected state of the finite state machine into a game result. A means is provided for displaying the game result.

In a preferred embodiment, the gaming machine generates at least two random game results per game. The circuit can include a counter and can generate a random game result in accordance with either a uniform probability distribution or a nonuniform probability distribution.

In a gaming machine requiring generation of at least two random numbers per game, one embodiment of the present invention includes means for generating a random number within a first predetermined range of numbers. The generating means includes a clock input. The generating means cycles through a plurality of states, each state corresponding to one of the numbers within the first predetermined range of numbers. The gaming machine also includes means for sequentially querying the generating means to select the existing state of the generating means as a random number. A noisy oscillator is provided for producing a signal having a random frequency within a second predetermined range of values. The signal is input to the clock input. The gaming machine has means for translating the sequentially selected random numbers into at least one game outcome and means for displaying the game outcome. The generating means can include a counter. The random numbers can be either uniformly distributed or nonuniformly distributed over the first predetermined range of numbers. In one embodiment, each number in the first predetermined range of numbers corresponds to only a single state of the generating means.

In another embodiment of the present invention, a gaming machine having a nonuniform probability distribution includes means for generating a first random number uniformly distributed on a first predetermined range of numbers, means for generating a second random number uniformly distributed on a second predetermined range of numbers, a memory for storing a main array having an entry for each number in the first predetermined range of numbers and an alias array having an entry for each number in the first predetermined range of numbers. Each main array entry is a number within the second predetermined range of numbers and each alias array entry is a number in the first predetermined range of numbers. The gaming machine further includes a processor electronically connected to the memory, the first generating means and the second generating means. The processor determines a game result based upon the first random number, the second random number, the main array and the alias array. The gaming machine also includes means for displaying the game result. In one embodiment, the first generating means comprises a first counter and the second generating means comprises a second counter. The game result produced by the gaming machine can be the first random number when the second random number is less than or equal to the main array entry corresponding to the first random number. The game result can be the alias array entry corresponding to the first random number when the second random number is greater than the main array entry corresponding to the first random number. This system can be used in a slot machine.

A nonuniform probability distribution gaming machine having at least two stages, each stage of which has a corresponding number of possible game results, includes a first means for generating a first random number uniformly distributed on a first predetermined range of numbers corresponding to the set of possible game results for each stage. The first generating means includes a first clock input and cycles through a plurality of states, each state corresponding to one of the numbers within the first predetermined range of numbers. A second means is provided for generating a second random number uniformly distributed on a second predetermined range of numbers for each stage. The second generating means includes a second clock input. The second generating means cycles through a plurality of states, each state corresponding to one of the numbers within the second predetermined range of numbers. The gaming machine also includes means for sequentially querying the first generating means to select its existing state as a first random number for each stage. The gaming machine also includes means for sequentially querying the second generating means to select its existing state as a second random number for each stage. A first noisy oscillator produces a first signal having a random frequency within a first predetermined range of values, wherein the first signal is input to the first clock input. A second noisy oscillator produces a second signal having a random frequency within a second predetermined range of values, wherein the second signal is input to the second clock input. The gaming machine also includes a memory for storing a main array and an alias array for each stage. Each main array has an entry for each possible game result for that stage and each alias array has an entry for each possible game result for that stage. Each main array entry is a number within the second predetermined range of numbers for that stage. Each alias array entry is one of the possible game results for that stage. A processor is electronically connected to the memory, the first generating means and the second generating means. The processor determines a game result for each stage based upon the first random number, the second random number, the main array and the alias array for that stage. A means is provided for displaying the game results.

While ideally suited for use in slot machines, the present invention can be used in any game of chance where it is desired to have truly random game outcomes in games requiring generation of one or more random numbers. For example, the present invention could be used with games that simulate horse racing, card playing, bingo or keno.

BRIEF DESCRIPTION OF THE DRAWINGS

FIG. 3 is a table showing values of a main array and an alias array for use with a second embodiment of the present invention;

DETAILED DESCRIPTION OF THE PREFERRED EMBODIMENT

Figure 1:
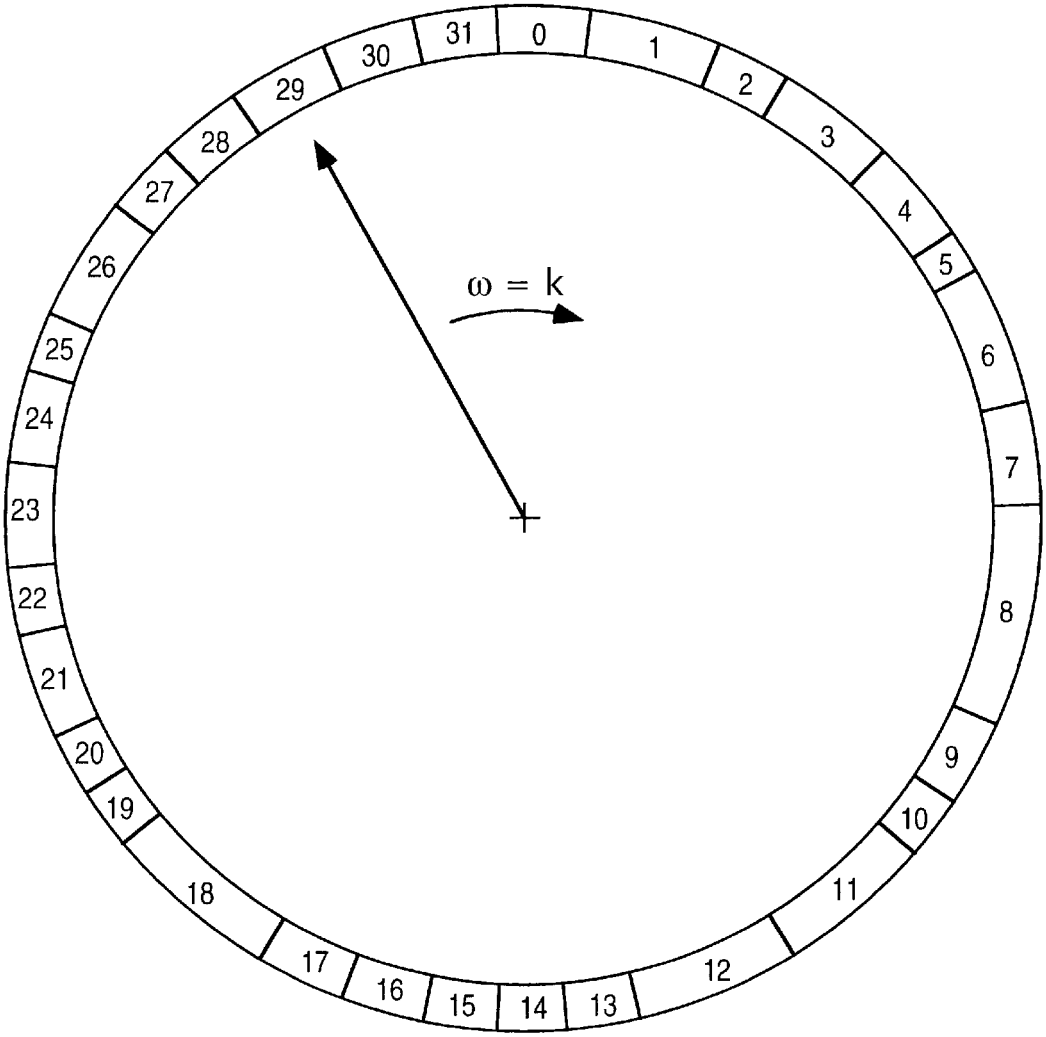
FIG. 1 Prior Art
FIG. 1 is a schematic diagram depicting selection of a reel stop position in a prior art gaming machine.
Figure 2:
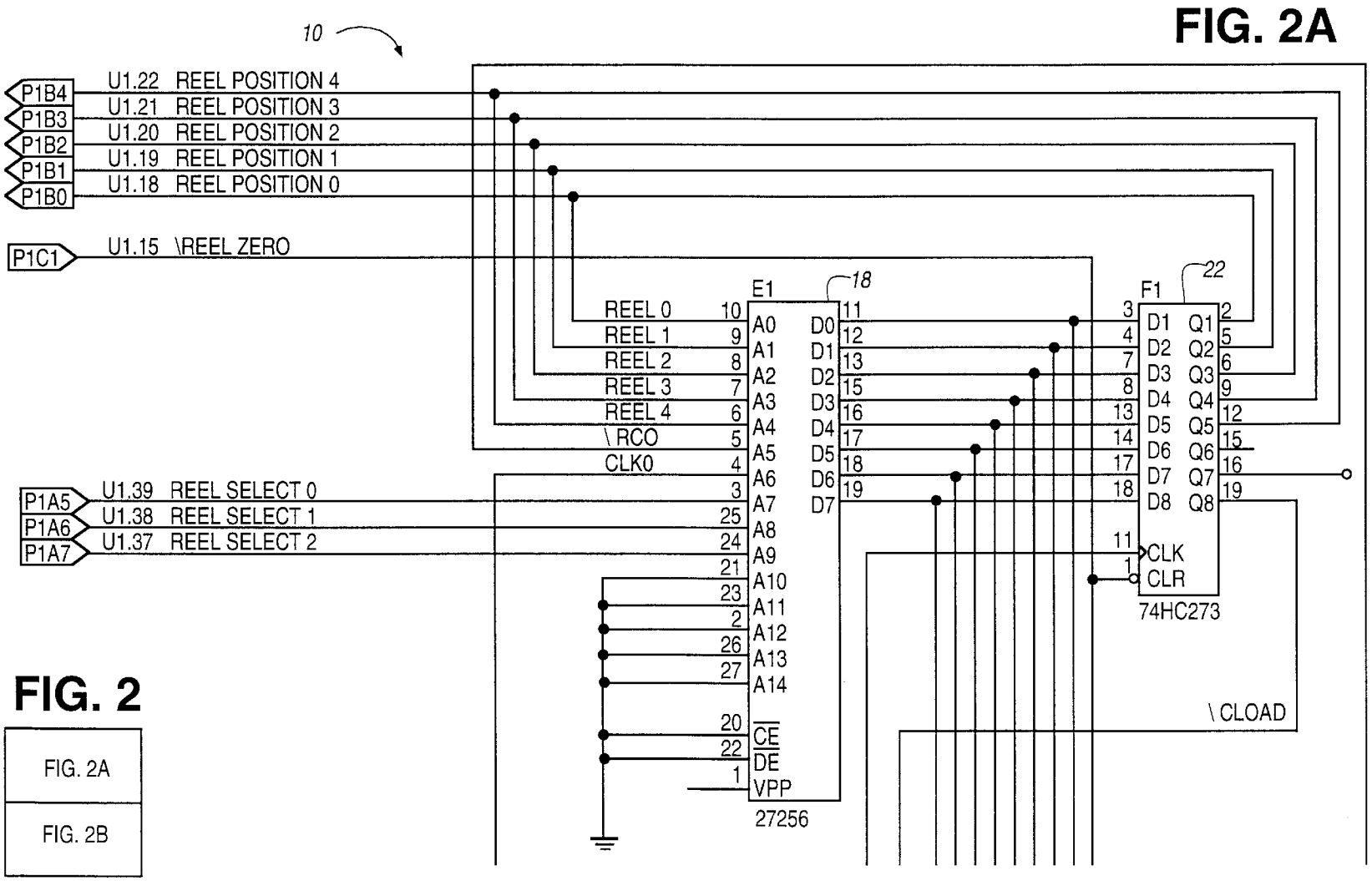
FIG. 2 is a circuit diagram of a game outcome logic in accordance with a first embodiment of the present invention.
Figure 2B:
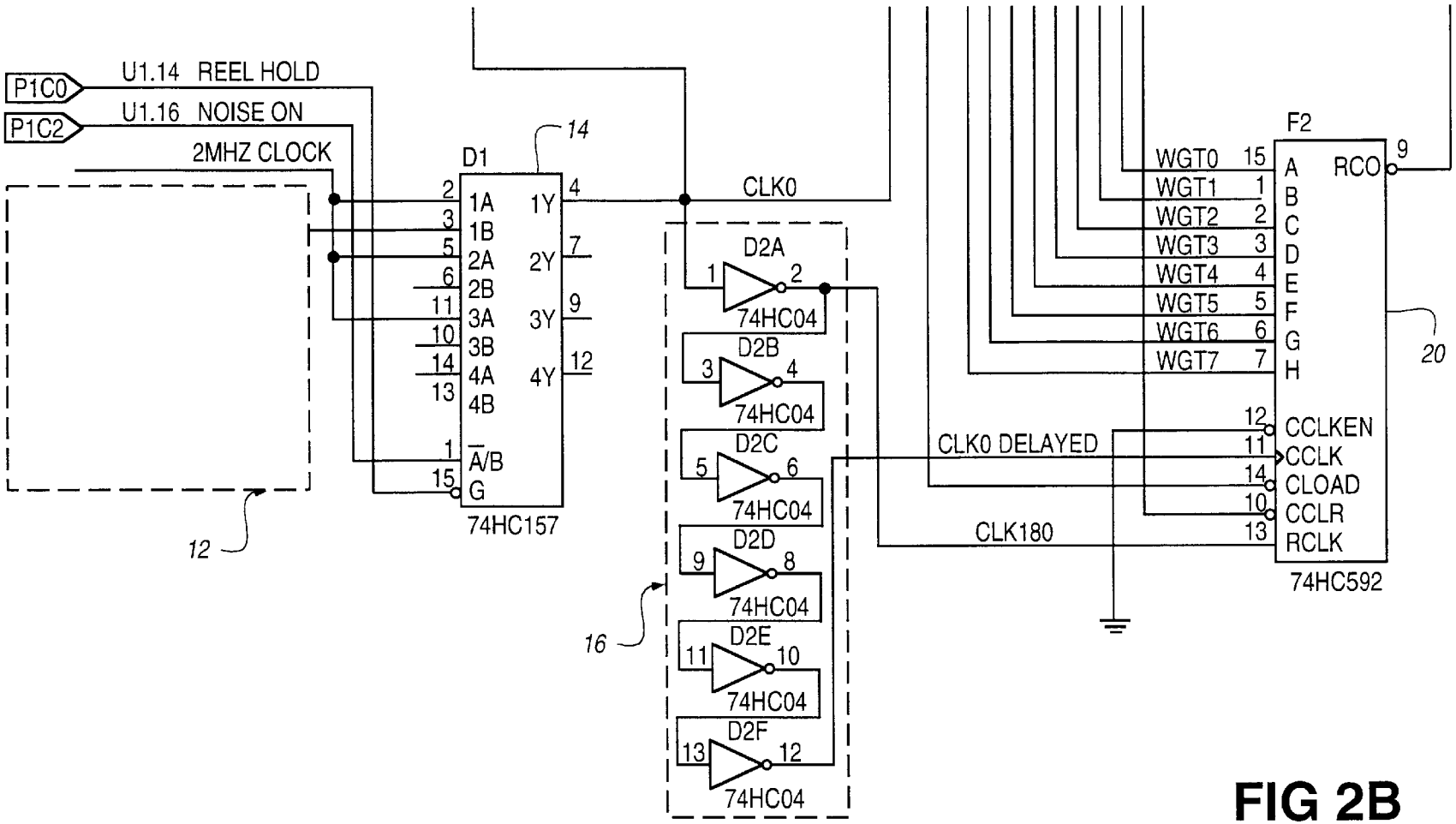

FIG. 2 shows one embodiment of the present invention that uses a circuit 10 for producing up to eight truly random reel stop positions, preferably in accordance with a nonuniform probability distribution. Alternatively, circuit 10 can generate random numbers in accordance with a uniform probability distribution. Circuit 10 yields truly random results thereby avoiding the problems shown schematically in FIG. 1. Although circuit 10 as shown in FIG. 2 produces up to eight truly random numbers, circuit 10 can be modified for applications requiring selection of a different quantity of random numbers.

Figure 5:
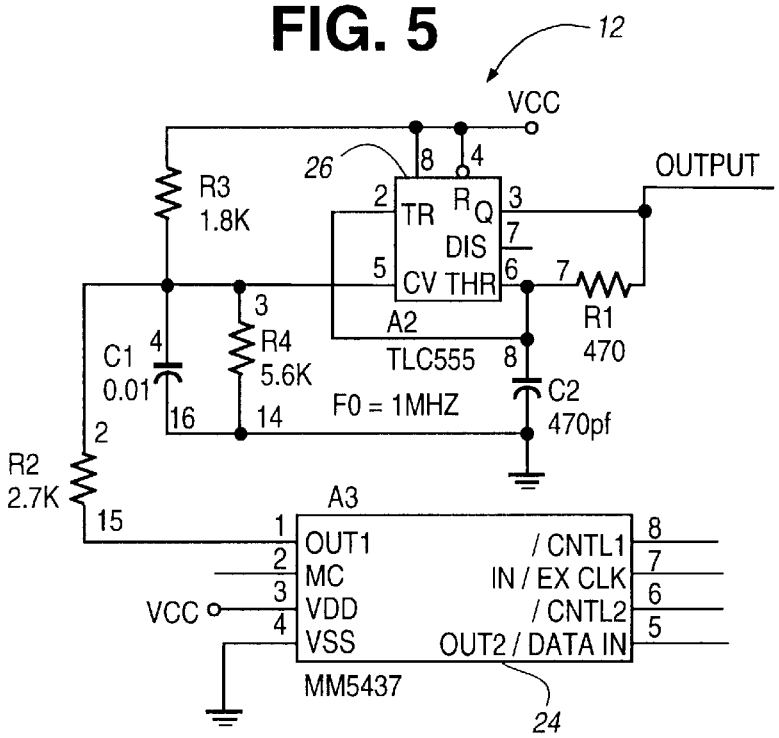
FIG. 5 is a circuit diagram of a noisy oscillator for use in the present invention.
Figure 6:
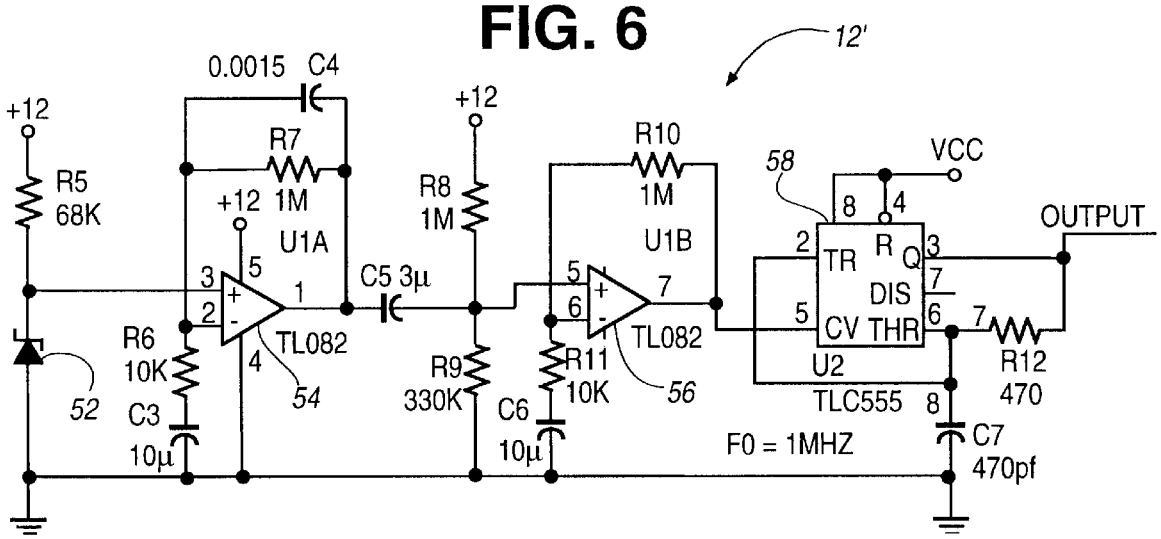
FIG. 6 is a circuit diagram of an alternative noisy oscillator for use in the present invention.

Circuit 10 includes a noisy oscillator 12, a multiplexer 14, a delay circuit 16, an EPROM 18, a preset counter 20 and a latch 22. Noisy oscillator 12 is shown as a black box in FIG. 2. Two noisy oscillators 12 and 12' that can be used with circuit 10 are shown in FIGS. 5 and 6 and are discussed in detail below. For now it is sufficient to note that noisy oscillator 12 outputs a clock signal to the remainder of circuit 10.

Multiplexer 14 can serve as a debugging device in testing circuit 10. Multiplexer 14 can select either the output of noisy oscillator 12 or a fixed frequency, e.g., 2 MHz, signal to be the CLKØ signal through the use of a NOISE ON signal. Multiplexer 14 has an inverted REEL HOLD signal inputted to its enable. REEL HOLD is used to suspend the current state of the finite state machine when the processor is reading a random number from circuit 10.

EPROM 18 can be a 27256 device available from Intel. EPROM 18 serves a dual purpose depending upon the value of CLKØ. When CLKØ is low, EPROM 18 acts as part of the reel stop position finite state machine. When CLKØ is high, EPROM 18 outputs a value equal to 256-W, where W is the weight for the current reel stop position held by latch 22.

In the example of FIG. 2, EPROM 18 stores such values corresponding to the probability distribution required for each of up to eight reels. The probability distribution may be uniform, but preferably is nonuniform. In the example of FIG. 2, EPROM 18 stores a value for each of the 32 reel stop positions on each of up to eight reels. Thus, each reel can have a different nonuniform probability distribution. EPROM 18 accepts as inputs the current reel stop position stored in latch 22 indicated by the five bits REELØ–REEL4, an inverted ripple carryout signal \RCO from preset counter 20, the CLKØ signal and three reel select signals REELSELECTØ–REELSELECT2 from the microprocessor to indicate which of the up to eight reels is to have its reel stop position chosen. This information allows EPROM 18 to output the proper value for the current reel stop position on this particular reel when CLKØ is high. EPROM 18 outputs this value over outputs DØ–D7 as a digital number between 0 and 255 (in the FIG. 2 embodiment) to preset counter 20.

Latch 22 holds the current reel stop position—i.e., the random reel stop position that is selected when circuit 10 is queried for a reel stop position. The current reel stop position is available to the microprocessor over lines REEL POSITIONØ–REEL POSITION4 output from latch 22. Latch 22 receives as input the output of EPROM 18, the CLKØ signal and a \REEL ZERO signal that is used to clear preset counter 20, latch 22 and the remainder of circuit 10 forming the finite state machine after a reel stop position has been selected so that data relating to the next reel can be loaded into latch 22. Latch 22 outputs the current reel stop position to the microprocessor and to inputs AØ–A4 of EPROM 18. Latch 22 also outputs a \CLOAD signal that is input to preset counter 20. The \CLOAD signal controls the loading of preset counter 20 and is a clocked image of \RCO delayed one clock time—i.e., if \RCO is high prior to the rise of CLKØ then \CLOAD will be high after the rise of CLKØ and if \RCO is low prior to the rise of CLKØ, then \CLOAD will be low after the rise of CLKØ.

When CLKØ is high, EPROM 18 outputs the value 256-W for the current reel stop position. This value is loaded into the input holding register of preset counter 20 on the rising edge of a CLK180 signal, which is an inversion of the CLKØ signal. Counter 20 receives the \REEL ZERO signal for clearing counter 20 in preparation for selecting the reel stop position for the subsequent reel after a reel stop position has been selected by the microprocessor. Counter 20 is clocked by a CLKØ DELAYED signal that is output from delay circuit 16. The only output of counter 20 is a ripple carryout signal \RCO that is fed to EPROM 18 to indicate when counter 20 has finished counting with respect to the current reel stop position.

In operation, circuit 10 works as follows. It is assumed that EPROM 18 stores values for each of the reel stop positions for each of the up to eight reels and that the REELSELECT signals are set to cause EPROM 18 to output the values corresponding to the first reel.

At a given point in time, latch 22 holds the current reel stop position and counter 20 is in the process of counting up from 256-W for the current reel stop position. It is assumed that CLKØ is currently low. Assuming counter 20 has not yet reached 255, \RCO is high and the next state of the reel stop state machine is the same as the current state. When CLKØ goes high, EPROM 18 outputs the value 256-W for the current reel stop position. This value is loaded into the input holding register of preset counter 20 on the rising edge of CLK180. This load is present at the output of EPROM 18 whenever CLKØ is high, is clocked into the input holding register of counter 20 at each rise of the CLK180 signal, but is only loaded into the counter register of counter 20 when the \CLOAD line rises at the end of the first clock cycle of counter 20 for each reel stop position. If the weight for this reel stop position is W, the value loaded into the counter register is 256-W, which will cause \RCO to fall W-1 clock cycles later, thereby starting the sequence that will advance to the next reel stop position.

Eventually, counter 20 finishes counting for the current reel stop position, causing \RCO to go low. On the next rising edge of CLKØ, the next reel stop position is clocked into latch 22 and fed back into EPROM 18. EPROM 18 then outputs the weight of the new reel stop position. After the rise of CLKØ, \CLOAD goes low which causes the value of 256-W for the new reel stop position to be inputted into the counter register of preset counter 20. Counter 20 then begins counting toward 255 again.

In this way, latch 22 holds a number corresponding to a reel stop position for a length of time based upon the weight for that reel stop position as measured in clock pulses of the CLKØ signal. When the NOISE ON signal is high, the clock pulses of the CLKØ signal come at a random frequency produced by noisy oscillator 12. Eventually, the microprocessor causes the REEL HOLD signal to go high when it is time to select the first random number. This value is output to the microprocessor via signals REEL POSITION-Ø–REEL POSITION4 and is selected as the reel stop position for the first reel. This reel stop position can be displayed on a physical reel or on a video depiction of a reel or other suitable means.

After the microprocessor has received the randomly selected reel stop position for the first reel, the \REEL ZERO signal goes low to clear counter 20 and latch 22. Subsequently, the REELSELECT signals are selected so that EPROM 18 will now output values based upon the probability distribution for the second reel. Thus, counter 20 and latch 22 will cycle through states based upon the probability distribution for the second reel. At a future point in time, the microprocessor will again raise the REEL HOLD signal and a reel stop position for the second reel will be selected.

The variable frequency of the CLKØ signal causes counter 20 and latch 22 to cycle through their states an unpredictable and variable number of times between successive queries of circuit 10 by the microprocessor to select random numbers. The processor of the slot machine may complete its various tasks between reel stop position selections in a fixed amount of time. In this fixed amount of real time, however, counter 20 and latch 22 will cycle through their states a random number of times because of the randomness of the frequency of the CLKØ signal. Thus, even though the next reel stop position is selected at a fixed amount of time after the reel stop position for the previous reel, the reel stop position is truly random because counter 20 and latch 22 have cycled through their states a random number of times. As such, even after the first reel stop position is determined, any reel stop position can be present in latch 22 when the second and subsequent random numbers are selected. In this way, the present invention eliminates the lack of randomness in the prior art depicted in FIG. 1.

FIG. 5 depicts a noisy oscillator 12 which can be used in the present invention. An alternative noisy oscillator 12' which could be used in circuit 10 is shown in FIG. 6 and is described below. Noisy oscillator 12 includes a digital noise source 24, resistors $R_1$, $R_2$, $R_3$ and $R_4$, capacitors $C_1$ and $C_2$ and an astable multivibrator 26. Resistors $R_1$, $R_2$, $R_3$ and $R_4$ can have resistances of 470 Ω, 2.7 kΩ, 1.8 kΩ and 5.6 kΩ, respectively. Capacitors $C_1$ and $C_2$ can have capacitances of 0.01 F and 470 pF, respectively.

Digital noise source 24 can be an MM5437 device available from National Semiconductor. Digital noise source 24 has its $V_{DD}$ input tied to an external supply voltage $V_{cc}$ and its $V_{SS}$ input tied to ground. Digital noise source 24 produces a white noise signal with uniform noise quality and output amplitude. The output OUT1 of digital noise source 24 is filtered by resistors $R_2$, $R_3$ and $R_4$ and capacitor $C_1$ and is fed to control pin CV of astable multivibrator 26. Astable multivibrator 26 can be a TLC555 manufactured by Texas Instruments. The voltage present at control pin CV controls the frequency of astable multivibrator 26. Digital noise source 24 varies the voltage on control pin CV in a random manner, thereby varying the frequency of astable multivibrator 26 in a random manner. Astable multivibrator 26 can have a baseline frequency of, e.g., 1 MHz. Use of digital noise source 24 as described herein causes the frequency of astable multivibrator 26 to vary from about 0.5 MHz to about 1.5 MHz. Noisy oscillator 12 outputs a clock signal OUTPUT from astable multivibrator 26. The OUTPUT signal is fed to the remainder of circuit 10.

Noisy oscillator 12 provides truly random results in most circumstances. However, noisy oscillator 12 has limitations to its performance based upon the fact that digital noise source 24 is an MM5437 device which uses a 23-bit shift register to generate a pseudo-random number output which is fed to control pin CV of astable multivibrator 26. Where a gaming machine requires a sufficiently large number of distinct game outcomes, noisy oscillator 12 cannot be used to achieve all such outcomes because digital noise source 24 is a PRNG with a finite number of output sequences as described above in the "Background of the Invention."

An alternative noisy oscillator 12' providing a solution to this problem is shown in FIG. 6. Noisy oscillator 12' generally includes a noise diode 52, op amps 54 and 56, an astable multivibrator 58, resistors $R_5$–$R_{12}$ and capacitors $C_3$–$C_7$. Noisy oscillator 12' uses an independent physical process to generate the numbers, unlike a finite state machine whose next state is dependent upon its previous state. In particular, noisy oscillator 12' uses the memory-free, independent physical process of the noise generated by noise diode 52.

Noise diode 52 can be a Model MDF603A, 8.9 volt, 45 microamp diode available from MDF products of Danbury, Op amps 54 and 56 can be TL082 and astable multivibrator 58 can be TLC555, all available from Texas Instruments. Resistors $R_5$–$R_{12}$ can have values of 68 kΩ, 10 kΩ, 1 MΩ, 1 MΩ, 330 kΩ, 1 MΩ, 10 kΩ and 470 Ω, respectively. Capacitors $C_3$–$C_7$ can have the values of 10 μF, 0.0015 μF, 3 μF, 10 μF and 470 pF, respectively.

In operation, noise diode 52 provides broadband noise of about 4 microvolts per root hertz. As only the low frequency components of this noise will be used subsequently, this noise is both low pass filtered and amplified by a factor of 100 by op amp 54 and its associated components. Op amp 56 provides additional gain of 100 and causes the dc operating point of its output to be at about 3 volts, the desired operating range for the control voltage of astable multivibrator 58. The total gain and low pass filtering produce a signal of approximately 3 volts peak to peak at the control voltage input CV to the astable multivibrator 58.

This causes the output clock frequency to vary from about 0.5 MHz to about 1.25 MHz.

Noisy oscillator 12' can be substituted for noisy oscillator 12 in circuit 10. Although noisy oscillator 12' can be somewhat more expensive than noisy oscillator 12, noisy oscillator 12' provides the ability to generate truly random numbers even when the number of possible game outcomes is extremely large. In addition, testing of noisy oscillator 12' is much simpler and more practical than attempting to test a large shift register.

In another embodiment, a gaming machine according to the present invention selects a reel stop position based upon a nonuniform probability distribution by initially generating two random numbers based upon uniform probability distributions. The gaming machine utilizes two predefined arrays for each reel as shown, e.g., in FIG. 3. The two arrays are a main array and an alias array. The main array and the alias array are stored in a memory and include entries for each reel stop position on each reel. Although in FIG. 3 a main array and an alias array are shown only for one reel, multiple main arrays and alias arrays can be used if different probability distributions are desired for each reel on a gaming machine having multiple reels.

In the example of FIG. 3, the main array entry for each reel stop position is an integer between 0 and 255. A larger or smaller range can be used depending on the required resolution of the nonuniform probability distribution. The alias array entry for each reel stop position is an integer corresponding to one of the possible reel stop positions. The example in FIG. 3 depicts a relatively simple probability distribution.

The process for selecting a reel stop position based upon a nonuniform probability distribution involves generating two random numbers. A first random integer, K, is uniformly distributed on the set of numbers corresponding to the possible reel stop positions. In the example of FIG. 3, K is uniformly distributed on the interval [0 . . . 31]. A second random integer, R, is uniformly distributed on the interval [0 . . . 255] in the example of FIG. 3. Random values of K and R are generated. If R is less than or equal to main array [K], then the selected reel stop position is K. If not, the selected reel stop position is alias array [K].

In the example of FIG. 3, the main array and alias array are calculated as follows. The main array entry for each reel stop position initially is presumed to be 255. The probability for each reel stop position is calculated under this assumption—i.e., each reel stop position initially is calculated to have a probability of $1/32$=3.125%. Next, a discrepancy array is calculated. For each reel stop position, the discrepancy array holds a value that is equal to the difference between the calculated current probability for that reel stop position and the desired probability for that reel stop position. A count is kept of the number of reel stop positions with a nonzero discrepancy.

An iterative approach is then used to calculate a suitable main array and alias array to achieve the desired probability distribution. The reel stop position with the maximum positive discrepancy is identified and its main array entry is decreased to eliminate this discrepancy. The corresponding alias array entry for that reel stop position is modified to be the reel stop position having the maximum negative discrepancy. This adjustment does not affect any reel stop position whose discrepancy is already zero. Therefore, the count of the number of reel stop positions with a nonzero discrepancy is reduced by at least one. The remaining maximum positive discrepancy is identified and the process repeated. The steps are repeated until all of the discrepancies have been eliminated. At this point, a main array and an alias array are defined that have the required probability distribution.

Additional details regarding this process are available in: (1) "An Efficient Method for Generating Discrete Random Variables With General Distributions" by Alastair J. Walker, published in ACM Transactions on Mathematical Software, Vol. 3, No. 3, September 1977, pages 253–256; and (2) "Generating Discrete Random Variables in a Computer" by G. Marsaglia, published in Communications of the ACM 6, 1 (1963), pages 37–38, both of which are hereby incorporated by reference.

Figure 4:
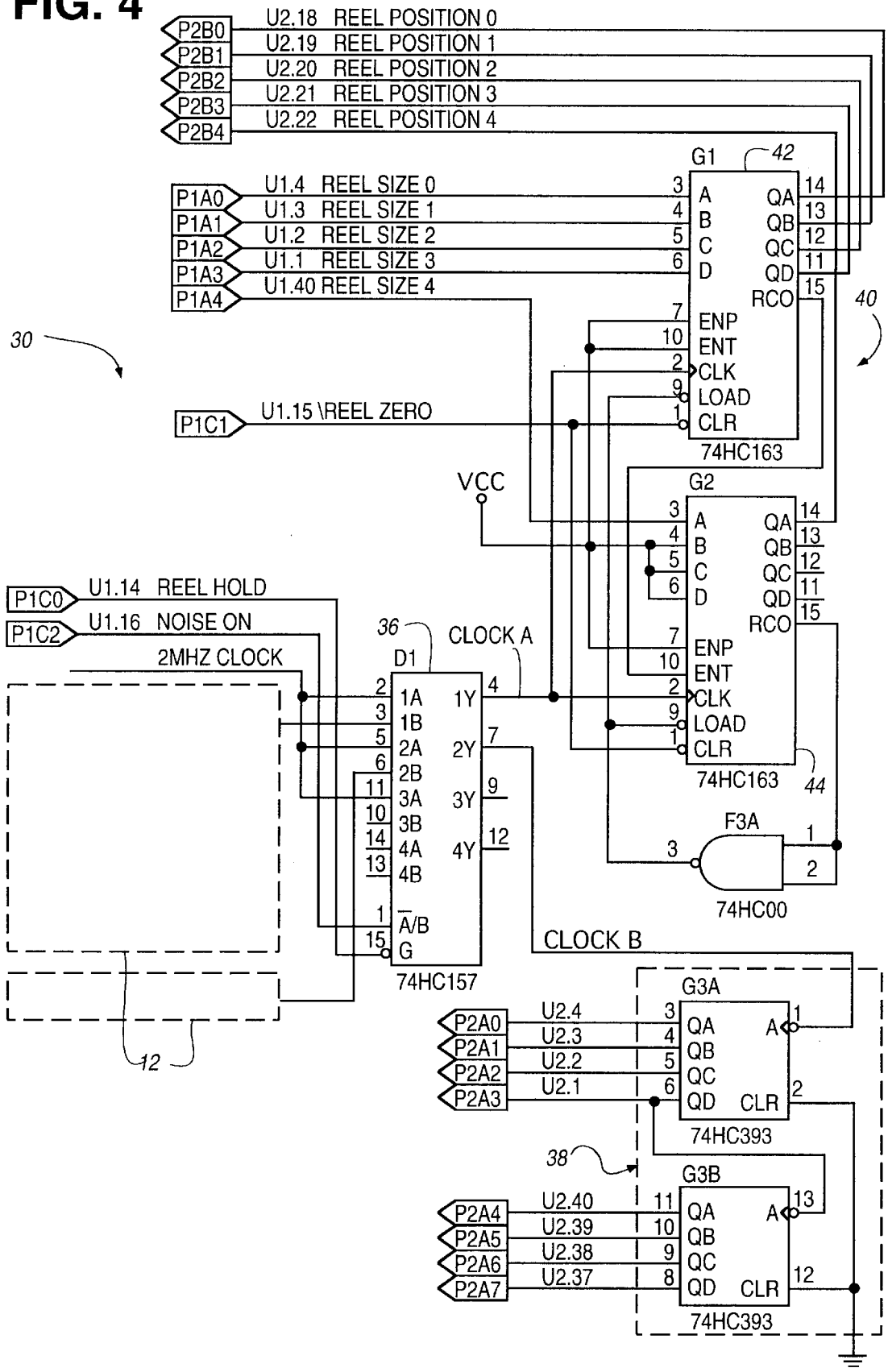
FIG. 4 is a circuit diagram showing a circuit for generating two random numbers in accordance with a second embodiment of the present invention.

FIG. 4 depicts a circuit 30 for generating random numbers K and R using the truly random number generation described above. Circuit 30 includes two noisy oscillators 12, a multiplexer 36, a free running counter 38 and a preset counter 40 made from counters 42 and 44. Noisy oscillators 12 operate in the same manner as noisy oscillator 12 described with respect to FIG. 2. One or both of noisy oscillators 12 can be replaced by noisy oscillator 12' of FIG. 6. Multiplexer 36 can serve as a debugging device in testing circuit 30, similar to the manner in which multiplexer 14 is used to test circuit 10.

Free running counter 38 counts from 0 to 255, incrementing with each pulse of the CLOCK B signal. A microprocessor (not shown) reads the value of counter 38 from port P2A.

Preset counter 40 accepts as input a value N, where N is equal to 32 minus the number of reel stop positions for this reel. N is placed in output port P1A by the microprocessor prior to launching the reel. After preset counter 40 reaches 31, N is again loaded into counter 40. The current value held by preset counter 40 is available to the microprocessor via port P2B. The value of integer R, described above, is read from port P2A. The value of integer K is determined by first reading the value stored in counter 40. The processor then subtracts N from this value to obtain the value of random integer K.

The main array and alias array values are stored in a memory accessible to the microprocessor. After the microprocessor has selected the randomly generated values of R and K, the microprocessor determines whether R is less than or equal to main array [K]. If it is, the selected reel stop position is K. If not, the selected reel stop position is alias array [K]. A \REEL ZERO signal subsequently goes low to clear counter 40. Subsequently, the microprocessor can select additional values of R and K generated by circuit 30 to obtain reel stop positions for a second reel and any subsequent reels.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A gaming machine, comprising:

a circuit for generating a random game result, said circuit comprising means for generating truly random events and means for producing, in accordance with at least one prespecified probability distribution, independent game results based upon said truly random events; and means for displaying the game result.

2. A gaming machine comprising:

a circuit for generating a random game result, said circuit comprising means for generating truly random events and means for producing, in accordance with at least one prespecified probability distribution, independent game results based upon said truly random events; and means for displaying the game result;

wherein said generating means comprises a noise diode.

3. A gaming machine, comprising:

a circuit for generating a random value, said circuit having a clock input;

noisy oscillator means for generating a clock input signal having a random frequency to be provided to said clock input;

means for selecting a state of said circuit as the random value;

means for translating the random value into a game result; and means for displaying the game result.

4. The gaming machine of claim 3 wherein said noisy oscillator means comprises a digital noise source.

5. The gaming machine of claim 4 wherein said noisy oscillator means comprises a shift register.

6. The gaming machine of claim 3 wherein said noisy oscillator means comprises means for generating noise from an independent physical process.

7. The gaming machine of claim 6 wherein said generating means comprises a noise diode.

8. The gaming machine of claim 7 wherein said generating means further comprises at least one op amp for amplifying noise generated by said noise diode.

9. A gaming machine, comprising:

a circuit for generating a random game result, at least a portion of said circuit forming a finite state machine wherein each state corresponds to a potential game result and wherein said circuit has a clock input;

noisy oscillator means for generating a clock input signal having a random frequency on a noisy oscillator output to be provided to said clock input, the clock input signal clocking the finite state machine through its states;

means for selecting a state of the finite state machine;

means for translating the selected state of the finite state machine into a game result; and means for displaying the game result.

10. The gaming machine of claim 9 wherein said circuit generates at least two random game results per game.

11. The gaming machine of claim 9 wherein said circuit includes a counter.

12. The gaming machine of claim 9 wherein said circuit generates a random game result in accordance with a uniform probability distribution.

13. The gaming machine of claim 9 wherein said circuit generates a random game result in accordance with a nonuniform probability distribution.

14. A gaming machine requiring generation of at least two random numbers per game, comprising:

means for generating a random number within a first predetermined range of numbers, said generating means including a clock input and said generating means cycling through a plurality of states, each state corresponding to one of the numbers within the first predetermined range of numbers;

means for sequentially querying said generating means to select the existing state of said generating means as a random number;

noisy oscillator means for producing a signal having a random frequency within a second predetermined range of values, wherein said signal is input to said clock input;

means for translating the sequentially selected random numbers into at least one game outcome; and means for displaying the at least one game outcome.

15. The gaming machine of claim 14 wherein said generating means includes a counter.

16. The gaming machine of claim 14 wherein the random numbers are uniformly distributed over the first predetermined range of numbers.

17. The gaming machine of claim 14 wherein the random numbers are nonuniformly distributed over the first predetermined range of numbers.

18. The gaming machine of claim 14 wherein each number in the first predetermined range of numbers corresponds to only a single state of said generating means.

19. A nonuniform probability distribution gaming machine having a number of possible game results, comprising:

means for generating a first random number uniformly distributed on a first predetermined range of numbers;

means for generating a second random number uniformly distributed on a second predetermined range of numbers;

a memory for storing a main array having an entry for each number in the first predetermined range of numbers and an alias array having an entry for each number in the first predetermined range of numbers wherein each main array entry is a number within the second predetermined range of numbers and wherein each alias array entry is a number in the first predetermined range of numbers;

a processor electronically connected to said memory, said means for generating a first random number and said means for generating a second random number, for determining a game result based upon said first random number, said second random number, said main array and said alias array; and means for displaying the game result.

20. The gaming machine of claim 19 wherein said means for generating a first random number comprises a first counter.

21. The gaming machine of claim 20 wherein said means for generating a second random number comprises a second counter.

22. The gaming machine of claim 19 wherein the game result is the first random number when the second random number is less than or equal to the main array entry corresponding to the first random number and wherein the game result is the alias array entry corresponding to the first random number when the second random number is greater than the main array entry corresponding to the first random number.

23. The gaming machine of claim 19 wherein the gaming machine is a slot machine.

24. A nonuniform probability distribution gaming machine having at least two stages, each stage of which has a corresponding number of possible game results, comprising:

first means for generating a first random number uniformly distributed on a first predetermined range of numbers corresponding to the set of possible game results for each stage, said first generating means including a first clock input and said first generating means cycling through a plurality of states, each state corresponding to one of the numbers within the first predetermined range of numbers;

second means for generating a second random number uniformly distributed on a second predetermined range of numbers for each stage, said second generating means including a second clock input and said second generating means cycling through a plurality of states, each state corresponding to one of the numbers within the second predetermined range of numbers;

means for sequentially querying said first generating means to select the existing state of said first generating means as a first random number for each stage;

means for sequentially querying said second generating means to select the existing state of said second generating means as a second random number for each stage;

first noisy oscillator means for producing a first signal having a random frequency within a first predetermined range of values, wherein said first signal is input to said first clock input;

second noisy oscillator means for producing a second signal having a random frequency within a second predetermined range of values, wherein said second signal is input to said second clock input;

a memory for storing a main array and an alias array for each stage, each said main array having an entry for each possible game result for that stage and each said alias array having an entry for each possible game result for that stage, wherein each main array entry is a number within the second predetermined range of numbers for that stage and wherein each alias array entry is one of the possible game results for that stage;

a processor electronically connected to said memory, said first generating means and said second generating means, said processor determining a game result for each stage based upon said first random number, said second random number, said main array and said alias array for that stage; and means for displaying the game results.

25. A gaming machine, comprising:

means for generating a random game result, said means comprising means for generating truly random events and means for producing, in accordance with at least one probability distribution, independent game results based upon said truly random events; and means for displaying the game result.

* * * * *